US005474433A

United States Patent [19]

Chang et al.

[11] Patent Number: 5,474,433

[45] Date of Patent: Dec. 12, 1995

[54] AXIAL SEALING MECHANISM OF VOLUTE COMPRESSOR

[75] Inventors: Yu-Choung Chang, Taipei; Shwu-Er Huang, Shin-Jwu; Su Tao, Gau-Shyong; Chih-Cheng Yang, Shin-Jwu, all of Taiwan

[73] Assignee: Industrial Technology Research Institute, Hsinchu, Taiwan

[21] Appl. No.: 277,296

[22] Filed: Jul. 21, 1994

[51] Int. Cl.[6] ..... F04C 18/04; F04C 27/00

[52] U.S. Cl. ..... 418/55.4; 418/55.5; 418/57

[58] Field of Search ..... 418/55.4, 55.5, 418/57

[56] References Cited

U.S. PATENT DOCUMENTS

| | | | |
|---|---|---|---|
| 3,924,977 | 12/1975 | McCullough | 418/55.5 |
| 4,365,941 | 12/1982 | Tojo et al. | 418/57 |
| 4,740,143 | 4/1988 | Nakamura et al. | 418/142 |
| 4,877,382 | 10/1989 | Caillat et al. | 418/57 |
| 5,277,563 | 1/1994 | Wen-Jen et al. | 418/57 |

FOREIGN PATENT DOCUMENTS

| | | | |
|---|---|---|---|
| 5149269 | 6/1993 | Japan | 418/55.5 |

*Primary Examiner*—John J. Vrablik
*Attorney, Agent, or Firm*—Browdy and Neimark

[57] ABSTRACT

An axial sealing mechanism of a volute compressor comprises a fixed volute member, a orbiting volute member, and an isolating member which is fastened to the back of the fixed volute member and provided with back pressure chambers into which an intermediate-pressure working fluid or a high-pressure working fluid is introduced via the compression chambers formed by the fixed volute member and the orbiting volute member. The pressing member in the back pressure chamber is therefore forced to urge axially the fixed volute member so as to overcome the axial thrust and the overturn moment of force, which exert on the fixed volute member at the time when the compression chambers are in operation. The axial gap between the fixed volute member and the orbiting volute member is thus minimized so as to prevent the working fluid from leaking out from the compression chambers and to improve the volumetric efficiency of the volute compressor.

11 Claims, 7 Drawing Sheets

AXIAL SEALING MECHANISM OF VOLUTE COMPRESSOR

FIELD OF THE INVENTION

The present invention relates generally to an axial sealing mechanism of volute compressor and more particularly to an obedient driving device having an improved volute member axial sealing.

BACKGROUND OF THE INVENTION

A volute compressor is mainly composed of a fixed volute member and an orbiting volute member, which engage each other to form simultaneously several closed spaces having a volume which becomes gradually smaller toward the center from the outer edge. The working principle of the conventional volute compressor is illustrated in FIG. 1. An orbiting volute member 10 is caused to revolve in relation to a fixed volute member 11 so as to cause the working fluid 60 outside the two volute members, as shown in FIG. 5, to enter the closed spaces via an inlet 15 to bring about compression. The working fluid 61 in the closed spaces is then forced to exit via an outlet 16 adjacent to the center of the fixed volute member 11 by the continuous orbiting motion of the orbiting volute member 10. As the closed spaces become gradually smaller, the compression process of the working fluid is thus attained. The compressed high-pressure fluid is designated by a reference numeral of 63.

The working fluid in motion is compressed such that the compressed fluid generates in the closed spaces an axial resultant thrust Fa, a radial resultant thrust Fr and a tangential resultant thrust Ft, as shown in FIG. 2. The axial resultant thrust forces the two volute members to move apart axially while the radial resultant thrust and the tangential resultant thrust act on the volute members such that an overturn moment of force is generated to result in the overturn of the volute member capable of making an axial movement. It is therefore conceivable that these three resultant forces must be effectively overcome so as to prevent the compressed working fluid from leaking severely from the end surface 45 of the two volute members and from the side surface 47 of the volute piece. The severe leak of the compressed working fluid can bring about a tremendous reduction in volumetric efficiency of the compressor.

The prior art methods of overcoming the problem of leakage of the working fluid, which takes place in the end surfaces of the two volute members, are described respectively hereinafter.

As disclosed in the U.S. Pat. No. 4,365,941, the working fluid in the intermediate compression chamber is guided to arrive in the back pressure chamber located behind the orbiting volute member and formed by the skeleton and the fixed volute member. The motion of the orbiting volute member is thus brought about by a fluid back pressure generated in the back pressure chamber, thereby forcing the orbiting volute member to move to remain in a close contact with the fixed volute member so as to seal off the end surfaces of the two volute members.

Another U.S. Pat. No. 4,877,382 discloses a method in which the working fluid in the intermediate compression chamber or the high compression chamber is guided to enter the back of the fixed volute member. The fixed volute member is forced to move to remain in a close contact with the orbiting volute member by a fluid back pressure generated in the back pressure chamber formed by the sealing member and the circular groove located in the back of the fixed volute member, thereby effecting the sealing of the end surfaces of the two volute members.

Such prior art methods as described are limited in design in that the back of the volute member is directly acted on by the back pressure which is in fact the fluid pressure of the compressed working fluid. The axial resultant thrust Fa generated in the compression chamber can be therefore overcome; nevertheless the axial back pressure that is required to overcome the overturn moment of force M produced by the overturn fulcrum I must be greatly increased. This is due to the fact that the anti-overturn arm of force of the anti-overturn fulcrum J of the net axial force (back pressure resultant force Fb-axial resultant force Fa) acting on the volute member is shorter, as shown in FIG. 3. The excessiveness of the axial back pressure can bring about an excessive abrasion of the end surfaces of the two volute members, thereby resulting in a reduction in the mechanical efficiency of the compressor as well as an increase in the temperature of the compressor.

There is still another prior art method of overcoming the leakage problem of the working fluid, as disclosed in the U.S. Pat. No. 4,740,143. This prior art method makes use of elastic sealing members, which are disposed on the end surfaces of the two volute members. The elastic sealing members 91 are precision components which can not be made econmically. In addition, the use of such elastic sealing members as described above does not eliminate the route of the leak of the working fluid, as illustrated in FIG. 4.

SUMMARY OF THE INVENTION

It is therefore the primary objective of the present invention to make use of the solid force of an axial motion mechanism to overcome the problem of the volute overturn so as to attain the effect of sealing two volute members of a volute compressor.

The sealing mechanism is disposed in the back of the fixed volute member and is composed of an isolating member and a predetermined number of pressing members. The compressed working fluid is guided to the back of the pressing members in the isolating member for pushing the pressing members. The fixed volute member is urged by the solid force to move axially to remain in a close contact with the orbiting volute member so as to overcome the leak that takes place in the end surface between the two volute members. The pressing members may be made of a sound-absorbing material and are therefore capable of reducing the noise that is made at the time when the pressing members make contact with the back of the fixed volute member.

The foregoing objective, working principle and advantages of the present invention will be more readily understood upon a thoughtful deliberation of the following detailed description of the preferred embodiments of the present invention in conjunction with the accompanying drawings.

DETAILED DESCRIPTION OF THE INVENTION

Figure 1A:
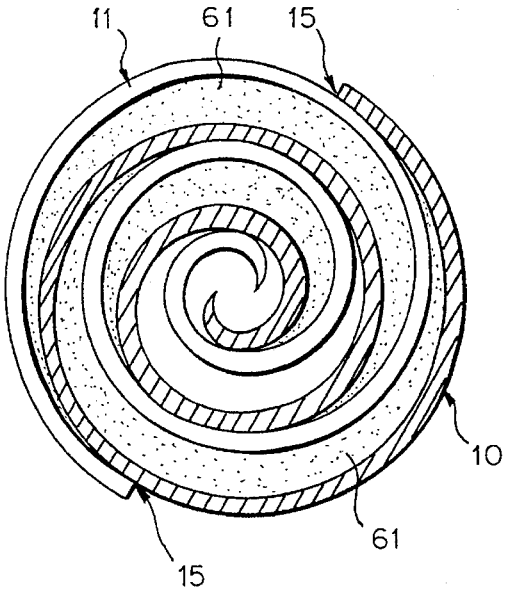
FIGS. 1(*a*) and 1(*b*) show a schematic view of the working principle of a prior art volute compressor.
Figure 1B:
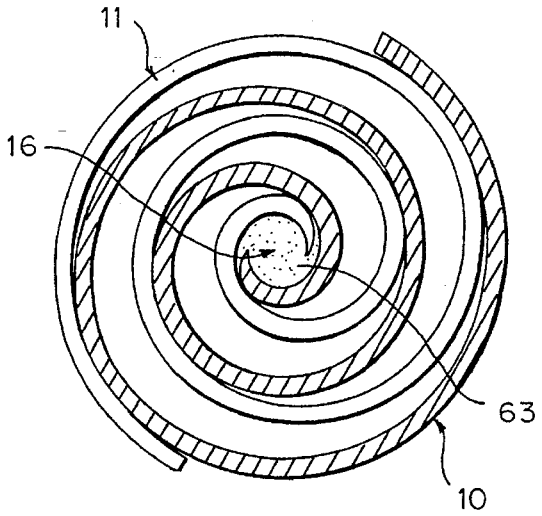
Figure 2:
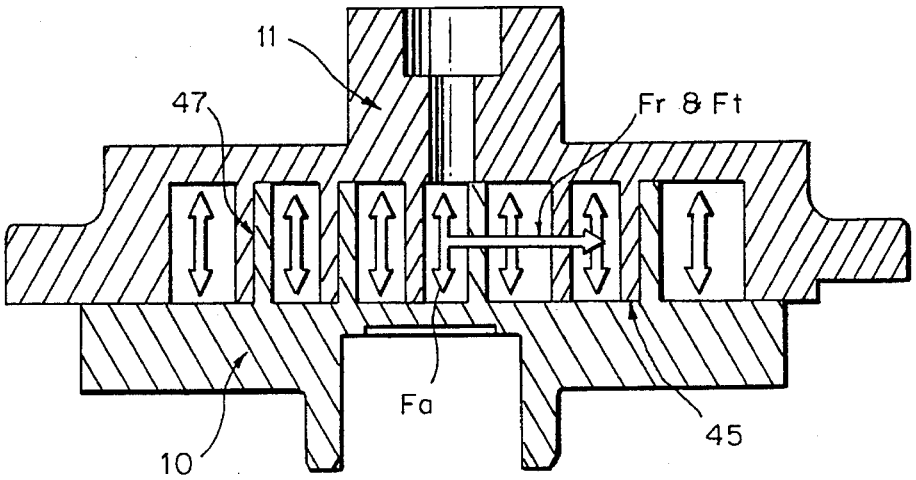
FIG. 2 is a schematic view showing that the volute piece is acted on by a force at the time when two volute members are in compression motion.
Figure 3A:
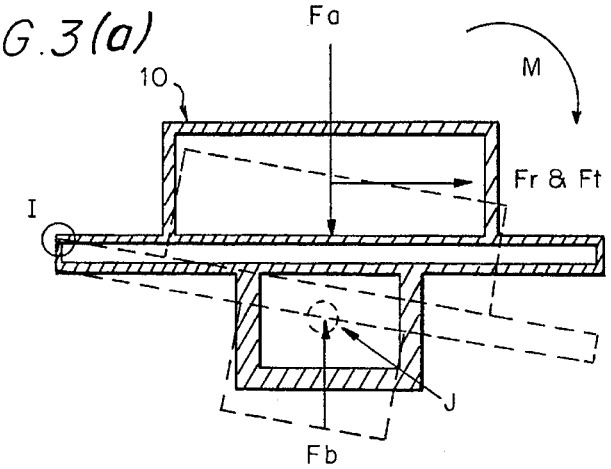
FIGS. 3(*a*) and 3(*b*) are schematic views showing that the compressed working fluid is guided to the back of the volute member by an anti-overturn arm of force.
Figure 3B:
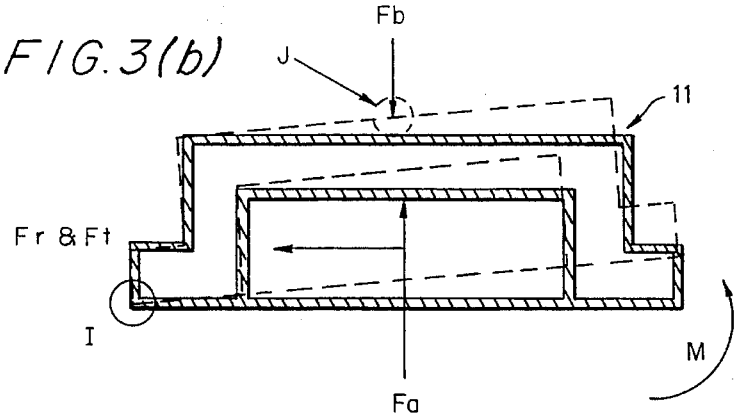
Figure 4:
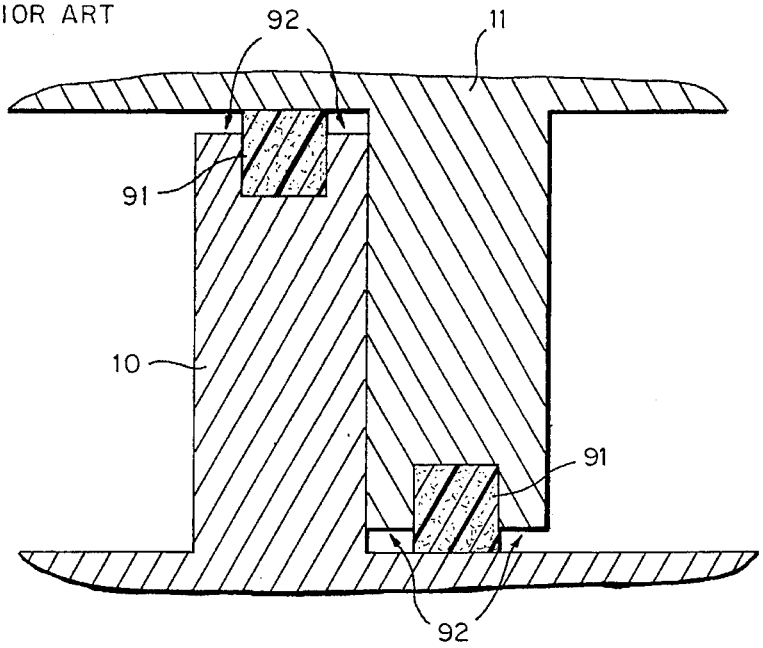
FIG.4 PRIOR ART
FIG. 4 is a schematic view illustrating the shortcoming of a scheme of disposing the elastic sealing element on the end surface of the volute piece.
Figure 5:
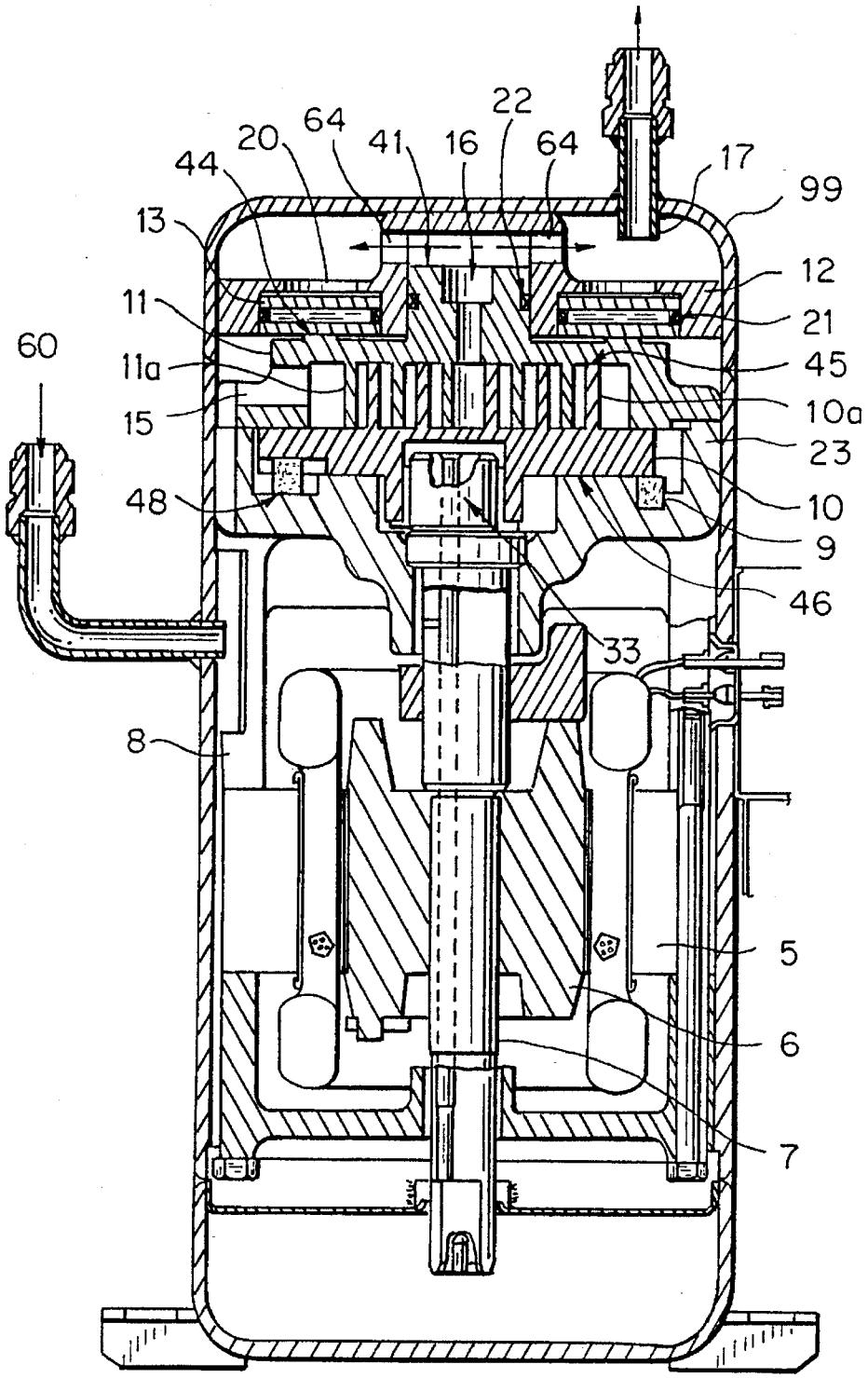
FIG. 5 shows a schematic view of the structure of a volute compressor of the present invention.

As shown in FIG. 5, a volute compressor of the present invention comprises mainly an orbiting volute member 10, a fixed volute member 11, an isolating member 12, predetermined number of pressing and holding members 13 (several pin cups or one ring cup), an Oldham ring 9, a skeleton 8, an eccentric shaft 7, a motor rotor 6, and motor stator 5. A housing 99 contains the compressor. The eccentric shaft and the motor rotor are fastened together. FIG. 5 is a generally cross-sectional view, but the pressing and holding members 13 are shown in elevational view, not cross sectional view, for clarity. The sealing collars or rings 21 are shown as solid black bands. FIGS. 10–13 are similar. As the motor is started, the rotor of motor actuates the eccentric shaft to turn. As a result, the eccentric pin 33 located at the top of the eccentric shaft actuates the orbiting volute member to engage in an eccentric motion in relation to the center of the motor rotor. The skeleton is provided at the top 48 thereof with the Oldham ring mechanism 9 serving to confine the orbiting volute member 10 to revolving around. As a result, the orbiting volute member 10 is not able to revolve on its own axis. In the meantime, the orbiting volute member 10 is urged by the fixed volute member 11 to press against the thrust bearing surface 46 while the fixed volute member 11 is fixed on the skeleton 8 by a key 23 which permits the fixed volute member 11 to move slightly and axially. The fixed volute member 11 and the orbiting volute member 10 are provided respectively with volute piece 11*a* and volute piece 10*a*, which are capable of forming therebetween a plurality of compression chambers. As the low pressure working fluid 60 is allowed to enter the compressor in the direction indicated by the arrow, the low pressure working fluid 60 is then sucked into the compression chamber via an inlet 15. The working fluid is finally let out via an outlet 16 adjacent to the center of the fixed volute member 11 in view of the fact that the orbiting volute member 10 continues to encircle. The working fluid is discharged from the compressor at the place 17 of the outer housing of the compressor.

Figure 6A:
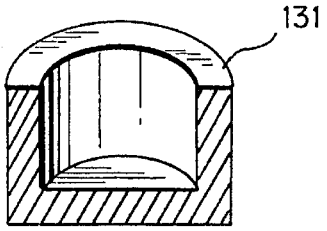
FIGS. 6(*a*) and 6(*b*) show schematic views of an embodiment of the pressing and holding member in the form of a pin cup, according to the present invention.
Figure 6B:
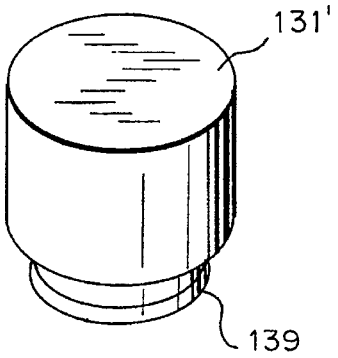
Figure 8A:
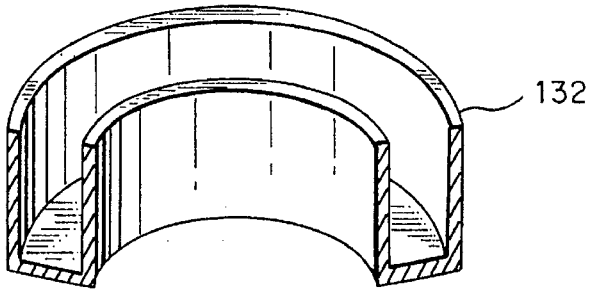
FIGS. 8(*a*) and 8(*b*) show schematic views of another embodiment of the pressing and holding member in the form of a ring cup, according to the present invention.
Figure 8B:
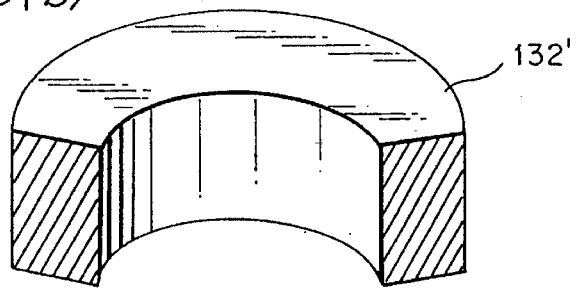

In order to keep the fixed volute member 11 to remain in a close contact with the orbiting volute member 10 all the time, the compressed working fluid is guided especially to the back pressure chamber 20 located at the back of the pressing member 13 (pin cup 131 or ring cup 132) inside the isolating member 12. The compressed working fluid is used to put a pressure on the pressing member 13, which is then caused by a net force to exert a pressure on the planar surface 44 of the back of the fixed volute member 11 so as to urge intensively the fixed volute member 11. The pressing member 13 may be of sound-absorbing material, or incorporate a piece of sound absorbing material. FIG. 6 shows a separate piece of sound-absorbing material 139. The orbiting volute member 10 is therefore urged by the member 11. In the meantime, the sealing requirements for two volute members in motion can be jointly accomplished by the resultant net force of the fluid force of the high pressure working fluid 64 which is located at the outlet of the top or neck portion 41 of the back of the fixed volute member 11. A through hole is provided in the center of the isolating member 12, dimensioned to slidably accept the neck portion 41 of the fixed volute member 11. The pressing member 13 is provided at the outer ring thereof with a sealing collar 21 for preventing the compressed working fluid from leaking out from the back pressure chamber 20. The pressing member 13 (pin cup 131 or ring cup 132) may be of a solid (131') (132') or hollow (131) (132) construction, as shown in FIGS. 6 and 8.

Figure 7:
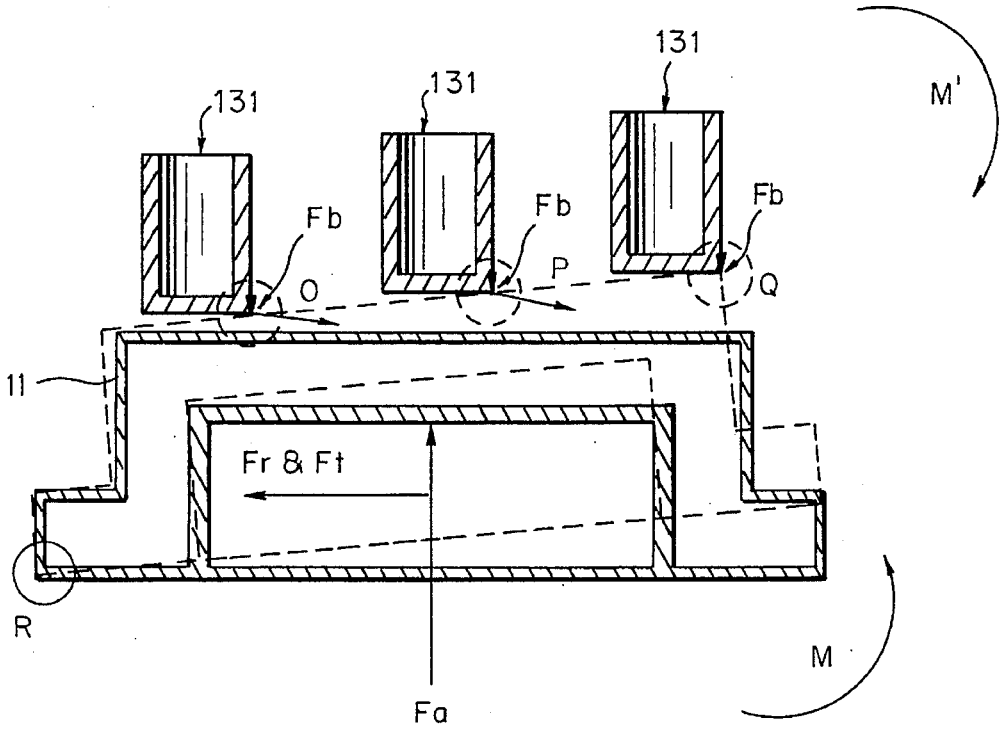
FIG. 7 is a schmatic view showing that the pressing and holding member (pin cup) of the present invention prevents the fixed volute member from being overturned.
Figure 9:
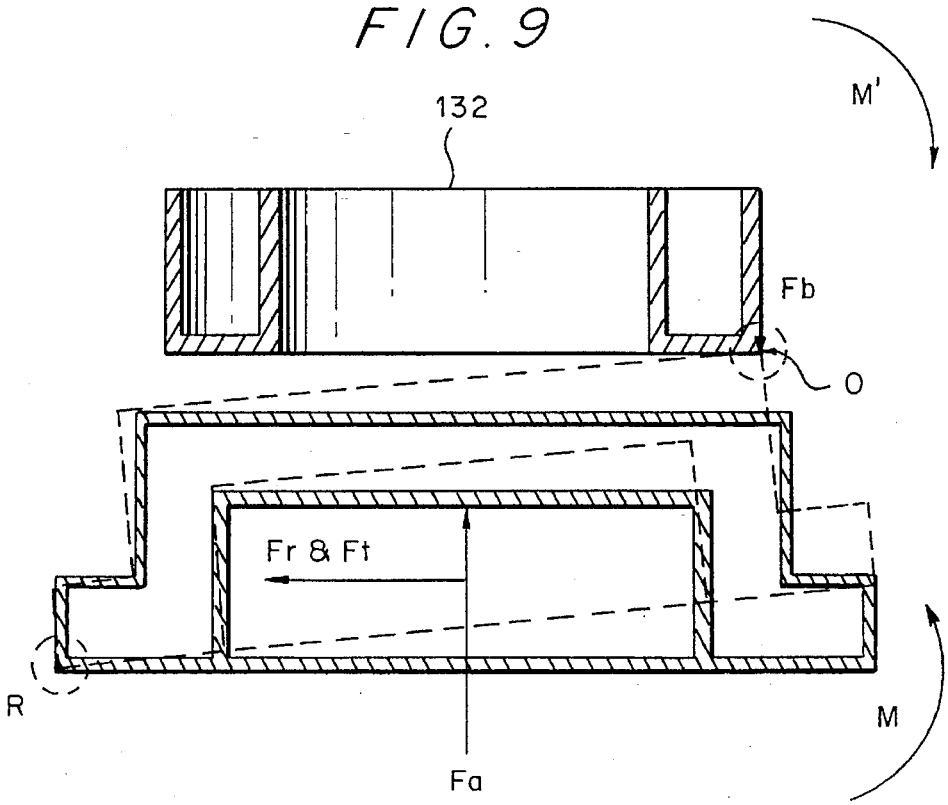
FIG. 9 is a schematic view showing that the pressing and holding member (ring cup) of the present invention prevents the fixed volute member from being overturned.

As shown in FIGS. 7 and 9, the contact position of the pressing member 13 and the fixed volute member 11 is located at the anti-overturn fulcrums O, P, Q (only O in FIG. 9) of the outermost edge of the pressing member 13, the anti-overturn arm of force of the fixed volute member 11 is therefore lengthened. The anti-overturn moment of force M' so produced can overcome more easily the overturn moment of force M coming from the fixed volute member 11. Because of the greater arm of force of the fixed volute member 11, the extra axial thrust Fb required for overcoming the overturn moment of force M produced on the overturn fulcrum R by the fixed volute member 11 acted on by the gas radial resultant force Fr, the gas tangential resultant force Ft and the gas axial resultant force Fa can be smaller. The abrasion among the top contact surface 45 of the two volute members and the orbiting volute member 10 and the thrust bearing surface 46 can be therefore minimized.

Figure 10:
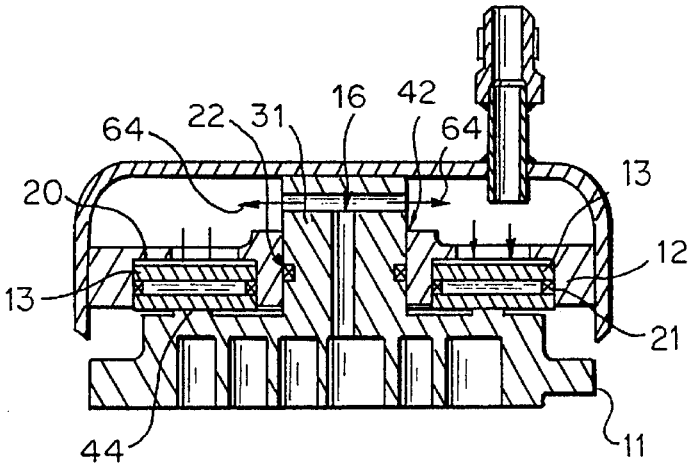
FIG. 10 is a schematic view showing that the high-pressure working fluid located at the outlet is guided to the back of the pressing and holding member of the present invention.
Figure 11:
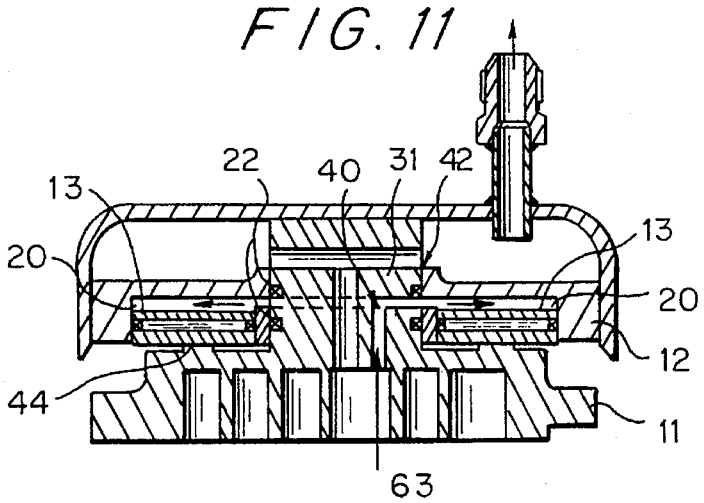
FIG. 11 is a schematic view showing that the high pressure working fluid located in the compression chamber is guided to the back of the pressing and holding member of the present invention.
Figure 12:
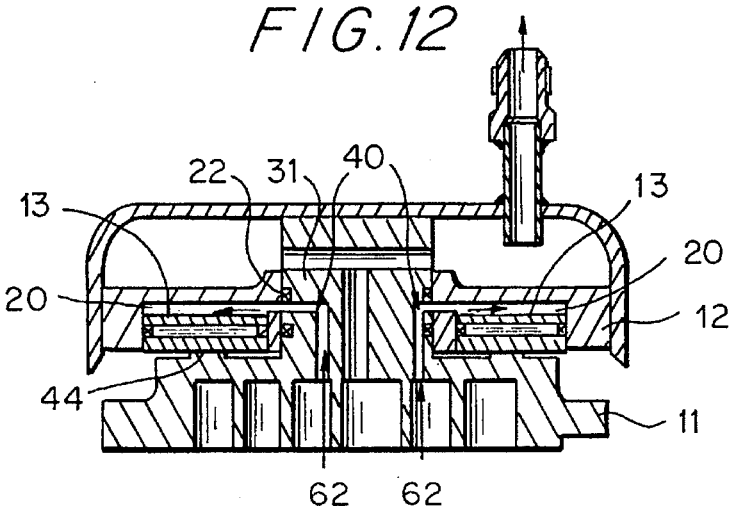
FIG. 12 is a schematic view showing that the intermediate pressure working fluid located in the compression chamber is guided to the back of the pressing and holding of the present invention.
Figure 13A:
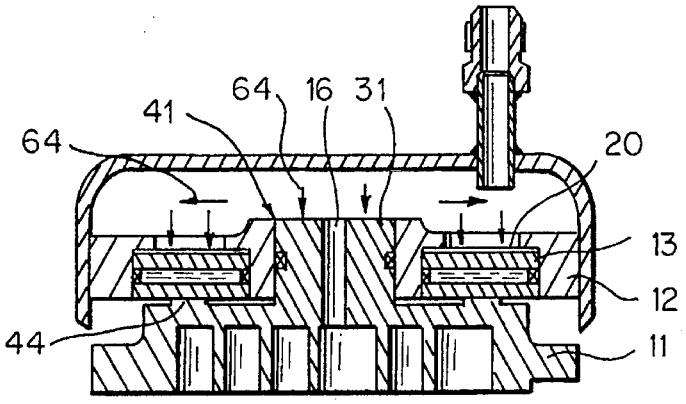
FIGS. 13(*a*), and 13(*b*), and 13(*c*) are schematic views showing that a solid force, which is generated after the intermediate pressure working fluid and the high pressure working fluid are guided to the back of the pressing and holding member, acts on the back of the fixed volute member in conjunction with the fluid force of the high pressure working fluid located at the outlet, according to the present invention.
Figure 13B:
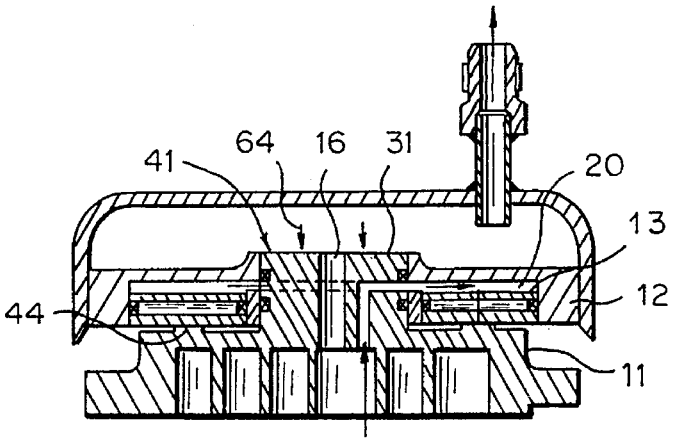
Figure 13C:
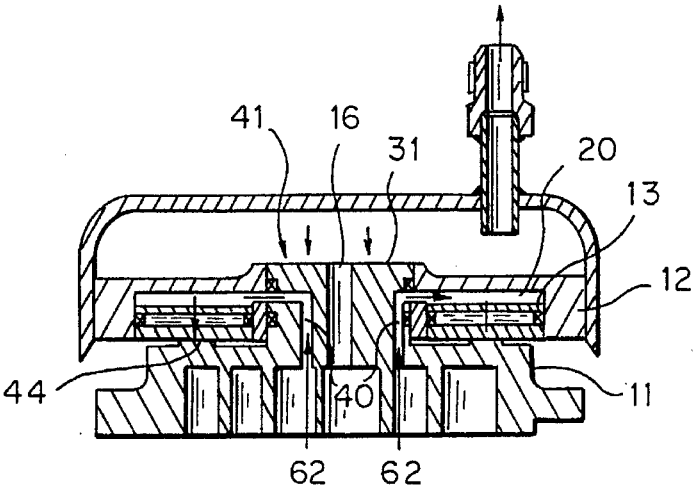

FIGS. 10–13 illustrate respectively the embodiments of the guiding of the compressed working fluids of the present invention. The working fluids, which are compressed variously, are designated by different reference numerals. FIG. 10 shows the embodiment in which the high pressure working fluid 64 located at the outlet 16 is guided to the back pressure chamber 20 in the isolating member 12. FIG. 11 illustrates the embodiment in which the high pressure working fluid 63 in the compression chamber is guided to the back pressure chamber 20 of the isolating member 12. FIG. 12 illustrates the embodiment in which the intermediate pressure working fluid 62 in the compression chamber is guided to the back pressure chamber 20 of the isolating member 12. The fixed voluted members 11 and the isolating members 12 of the embodiments illustrated in FIGS. 11 and 12 require the guiding channels 40 for guiding the compressed working fluids to the back pressure chambers 20. The sealing member 22 is disposed respectively at the outlet portion 31 of the fixed volute member 11 and at the ring surface 42 of the isolating member 12 for preventing the working fluid from leaking to the low pressure place from the high pressure place. FIG. 13 shows another embodiment of the present invention, in which the overturn of the fixed volute member 11 is overcome by the resultant net force of the solid force produced in a process in which the intermediate pressure working fluid and the high pressure working fluid are guided jointly to the back of the pressing member, and the fluid force of the high pressure working fluid 64 located at the outlet 16 of the shaft neck top surface 41 of the fixed volute member 11.

The present invention is characterized in that the pressure of the compressed working fluid can be applied flexibly along with the action area of the pressing member 13 so as to select and control easily the solid force so generated. As a result, the required and preferred back pressure value can be obtained with precision according to the present invention.

Furthermore, the back portion of the fixed volute member 11 and the contact planar surface 44 of the pressing member 13 may be of a ring-shaped flange surface for reducing the refined process quantity that is required by the back portion of the fixed volute member.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. In an axial volute compressor having a housing;

a fixed volute member provided therein with a first number of spiral volute pieces and further provided centrally with a through outlet; and an orbiting volute member provided protuberantly with the first number of spiral volute pieces which can be assembled with said fixed volute member such that said orbiting volute member and said fixed volute member form therebetween a plurality of compression cheers, and that said orbiting volute member can be driven by an external force to revolve around said fixed volute member without being able to rotate on a rotation axis thereof so as to guide a low-pressure working fluid to enter said compression chambers in which said low-pressure working fluid is so compressed as to become an intermediate-pressure working fluid before being further compressed to become a high-pressure working fluid, which is then discharged via said outlet of said fixed volute member of the volute compressor;

a sealing mechanism improvement comprising:

an isolating member is fixed in said housing such that an interior of said housing is divided into a high-pressure receiving chamber and a low-pressure receiving chamber in communication with each other via a through hole disposed therebetween, said isolating member further including at least one back pressure chamber at a distance from a through-hole axis of said through hole located between said high-pressure receiving chamber and said low-pressure receiving chamber, said back pressure chamber being contiguous to said low-pressure receiving chamber;

a neck portion is formed on an outlet peripheral edge of a discharge port of said fixed volute member disposed in said low-pressure receiving chamber, said neck portion being tubular in shape and dimensioned to fit into said through hole of said isolating member such that said neck portion is capable of making a micro-axial motion along the through-hole axis;

a leakproof element disposed between said neck portion and said through hole of said isolating member for preventing said high-pressure working fluid located at outlet from leaking out to said low-pressure receiving chamber;

at least one pressing member slidably disposed within said back pressure chamber and capable of making an axial motion parallel to said through-hole axis of said isolating member for engaging a back surface of said fixed volute member; wherein a compressed working fluid is guided through passage means into said back pressure chamber for actuating said pressing member to urge said back surface of said fixed volute member which is then caused to urge intensively said orbiting volute member so as to ensure that said orbiting volute member remains in a close axial contact with said fixed volute member at such time when said orbiting volute member is engaged in orbital motion, and that said compressed work fluid in each of said compression chambers is prevented from leaking out.

2. The improvement according to claim 1 wherein said pressing member is of selectively a solid cylindrical construction and a cup-shaped cylindrical construction.

3. The improvement according to claim 1 wherein said pressing member is made of a sound-absorbing material.

4. The improvement according to claim 1 wherein said pressing member and said fixed volute member have therebetween a contact portion provided with a sound-absorbing piece.

5. The improvement according to claim 1 wherein said back surface of said fixed volute member and said pressing member have therebetween a contact portion provided with a circular flange surface.

6. The improvement according to claim 1 wherein said isolating member is provided with a through hole in communication with said back pressure chamber and said high-pressure receiving chamber.

7. The improvement according to claim 1 wherein said neck portion of said fixed volute member is not connected with said housing of said compressor and is provided with a pressure-receiving surface capable of being acted on by a pressure of said high-pressure working fluid located at said outlet of said fixed volute member for reinforcing a pressure of said fixed volute member urging said orbiting volute member.

8. The improvement according to claim 1, including a plurality of back pressure chambers and a respectively corresponding plurality of pressing members.

9. The improvement according to claim 1, wherein said back pressure chamber of said isolating member is of a circular and slotted construction encircling said through-hole axis; and where said pressing member is of selectively a circular construction and a circular and cup-shaped construction.

10. The improvement according to claim 1, wherein said isolating member and said fixed volute member are provided with a guide hole in communication with said back pressure chamber and said compression chambers.

11. The improvement according to claim 1, wherein said compressed working fluid which is guided into said back pressure chamber is selectively a high-pressure working fluid located at said outlet of said fixed volute member, a high-pressure working fluid in said compression chambers, and an intermediate-pressure working fluid located in said compression chambers.

* * * * *